US005079903A

United States Patent [19]

Hakansson

[11] Patent Number: 5,079,903

[45] Date of Patent: Jan. 14, 1992

[54] GRIPPING HEAD FOR LOADING PACKAGES INTO CRATES

[75] Inventor: Bengt Hakansson, Sjobo, Sweden

[73] Assignee: Tatra Pak Holdings, S.A., Pully, Switzerland

[21] Appl. No.: 603,387

[22] Filed: Oct. 26, 1990

[51] Int. Cl.[5] ..... B65B 5/08

[52] U.S. Cl. ..... 53/473; 53/247; 294/65; 414/416

[58] Field of Search ..... 53/244, 247, 475, 473, 53/537, 538, 544; 414/416; 294/65

[56] References Cited

U.S. PATENT DOCUMENTS

| | | | |
|---|---|---|---|
| 3,168,204 | 2/1965 | Voullaire | 53/247 X |
| 3,212,227 | 10/1965 | Chidsey et al. | 53/473 |
| 3,386,224 | 6/1968 | Shuttleworth | 53/538 |
| 3,466,834 | 9/1969 | Standley et al. | 53/244 X |
| 4,905,456 | 3/1990 | Olaechea | 53/537 X |

*Primary Examiner*—Robert L. Spruill
*Assistant Examiner*—Linda B. Johnson
*Attorney, Agent, or Firm*—Burns, Doane, Swecker & Matthis

[57] ABSTRACT

A gripping head for loading packages into a crate is disclosed having a number of support members attached to a frame. The support members each have a predetermined number of pneumatically operated suction cups for gripping packages that are intended for loading into a crate. Two of the support members are capable of pivoting movement on the frame in response to vertical movement of a center support member so as to allow the gripping head to deposit the packages into the crate in a manner that is economical and that allows efficient use of the crate space.

17 Claims, 5 Drawing Sheets

101
102
104
104
100
138
106
139
139
130
134
130
140A, 140B
144
146
142A, 142B
108A
110A
136
132
132
103
103
116
112
122
120
114
107
105
128
124
126
118
118
118
S

GRIPPING HEAD FOR LOADING PACKAGES INTO CRATES

BACKGROUND OF THE INVENTION

The present invention relates to crate loading apparatus and particularly to a gripping head arrangement for loading packages into a crate.

In the liquid packaging industry, a great variety of packing crates already exist which provide the capability of securely packing liquid containers for transport. However, a significant number of the existing crates are designed for packing gable top packages such as "PURE PAK" packages and "TETRA REX" packages and not necessarily for rectangular box-shaped packages such as "TETRA BRIK" packages. Consequently, difficulty is sometimes encountered in easily and practically loading such rectangular box-shaped (parallelepiped) packages into existing packing crates. However, since it is not necessarily feasible or economical to develop a crate specifically designed for rectangular box-shaped (parallelepiped) packages, there is a desire and need to continue to use the already existing packing crates for packing the rectangular box-shaped packages.

Currently, packages are loaded into existing crates by a loading apparatus that uses guide plates to direct the packages into proper loading positions. In order to achieve proper loading of an entire crate, however, the guide plates must rise as each layer of packages is gathered into the crate. In addition, the guide plates tend to have a somewhat fragile design and thus are easily deformed or destroyed against the edges of the crates during use. Consequently, the crate packing machine is required to have a greater height than would otherwise be required. In addition, an operator must give added attention and care to avoid damage to or destruction of the guide plates which may cause unacceptable downtime of the crate packing machine.

OBJECTS AND SUMMARY OF THE INVENTION

It is an object of the present invention to avoid the above-described problems associated with current techniques of loading rectangular box-shaped packages into existing packing crates.

Another object of the present invention is to provide a gripping head that is capable of loading rectangular box-shaped packages into existing crates efficiently and economically.

A further object of the present invention is to provide a gripping head that loads rectangular box-shaped packages into a crate such that the packages fit snugly and compactly into the crate.

These objects as well as other objects which are apparent from the following description are achieved through a gripping head according to the present invention which includes a frame and first, second and third support members connected to the frame wherein the first, second and third support members each have a device for griping packages. The gripping head also includes a pivotal mounting mechanism for mounting the first and third members such that the first and third members are capable of pivoting movement relative to the frame. A central mounting mechanism is provided for mounting the second member to the frame between the first and third members and includes a device for moving the second member along a predetermined axis relative to the first and third members. A cam mechanism is also included between the first and third members for pivoting the first and third members in response to movement of the second member along the predetermined axis relative to the first and third members.

BRIEF DESCRIPTION OF THE DRAWINGS

A preferred embodiment of the present invention will be described in greater detail with reference to the accompanying drawings, wherein like elements bear like reference numerals and wherein.

DETAILED DESCRIPTION

Figure 1:
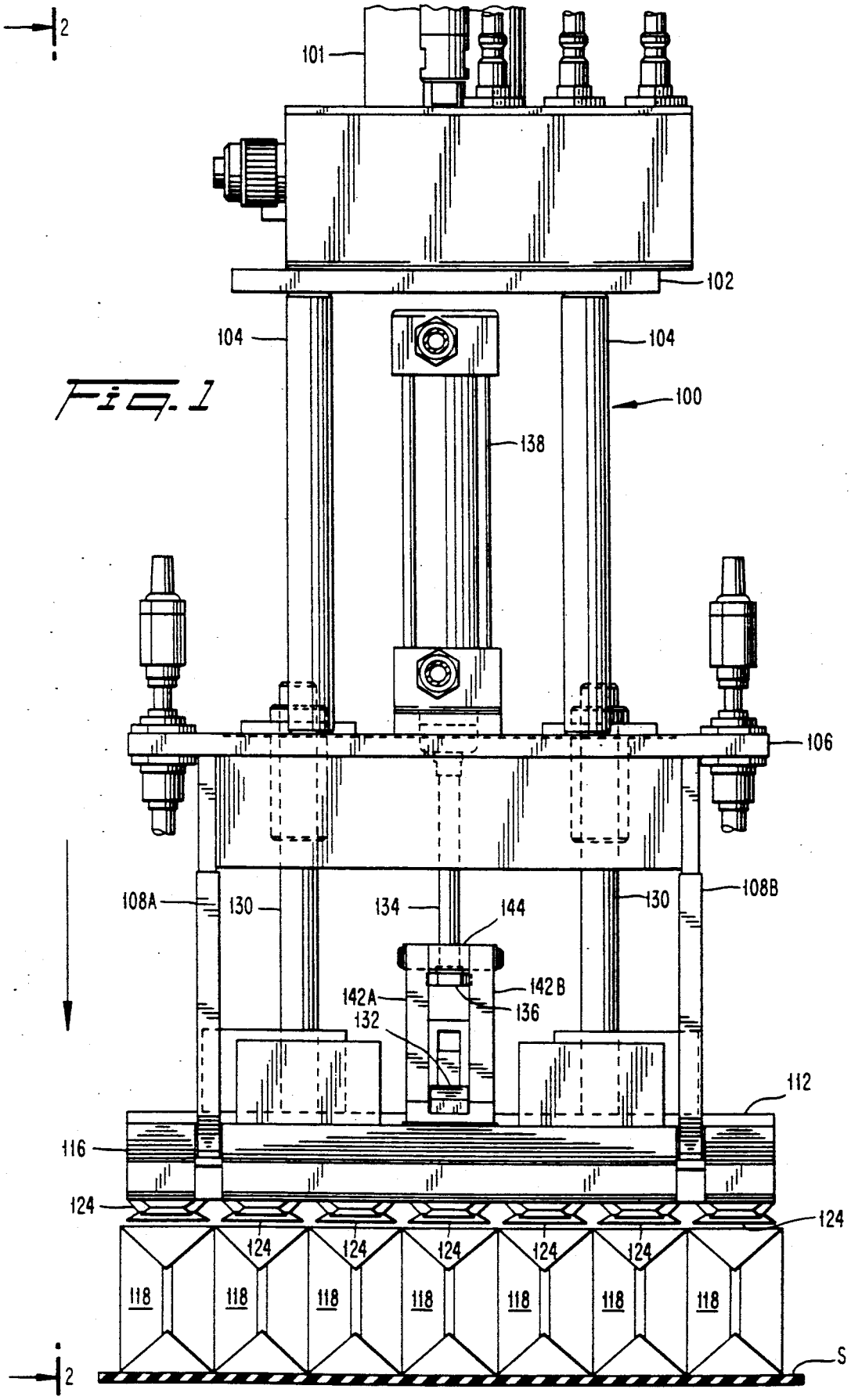
FIG. 1 is a front elevational view of a gripping head assembly according to the present invention.
Figure 2:
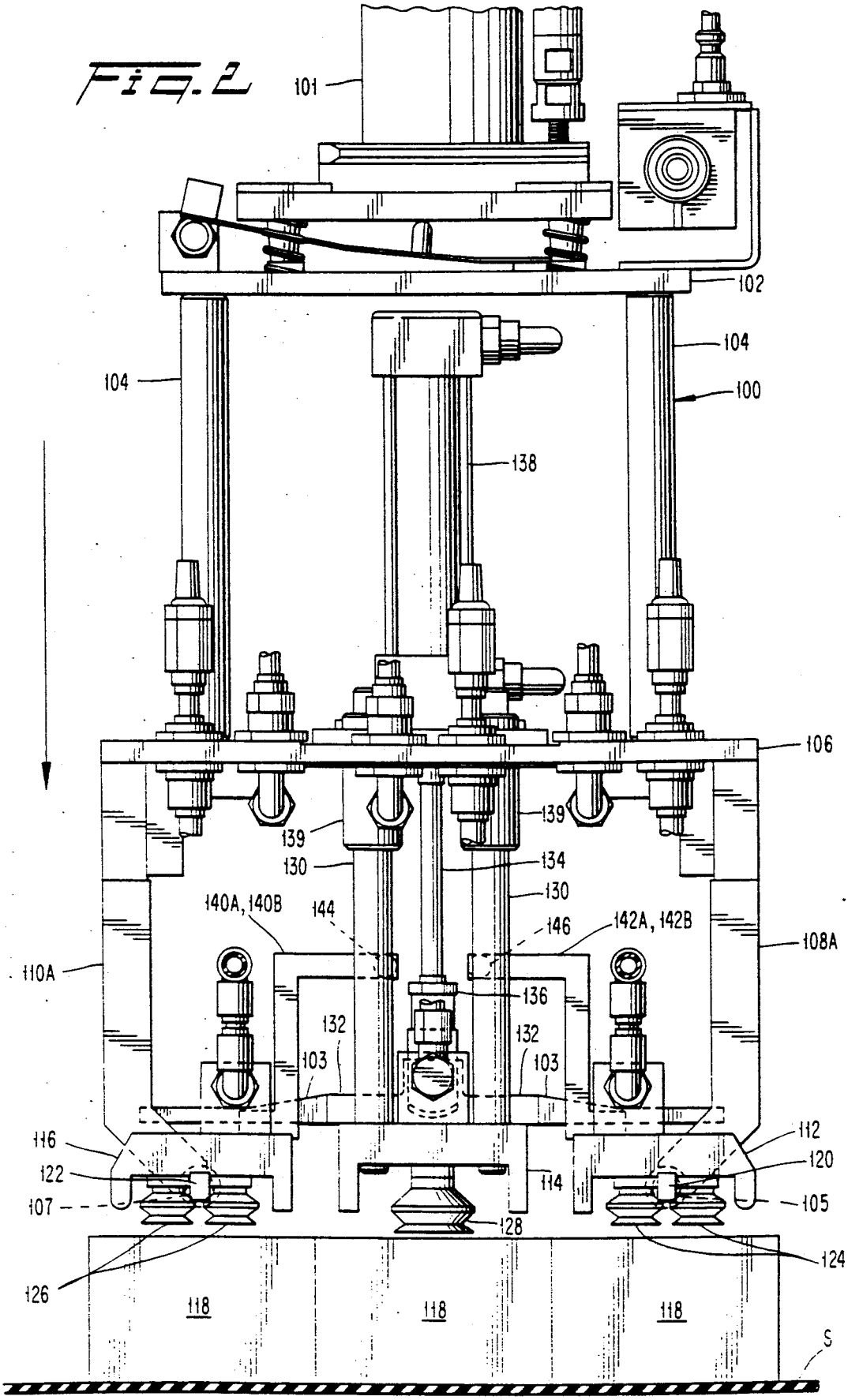
FIG. 2 is a side elevational view of the gripping head assembly taken along the line 2—2 in FIG. 1.

A gripping head in accordance with the present invention is generally shown in FIGS. 1 and 2 and includes a frame 100 having a first platform 102 connected to a second platform 106 by a plurality of vertical posts 104. The frame also includes support arms 108A, 108B, 110A, 110B generally extending from the underside of the second platform 106 at the four corners of the second platform 106. The entire frame 100 is vertically movable by means of an actuator 101 that is fixed to the first platform 102.

Disposed beneath the second platform 106 are first, second and third support members 112, 114, 116, each of which has a plurality of pneumatically operated suction cups 124, 128, 126, respectively. The pneumatically operated suction cups 124, 128, 126 are used for gripping packages 118 that are intended for loading into a crate.

The first support member 112 is pivotally attached by bushings 105 to the lower end of each of the extension arms 108A, 108B along a pivot axis 120 that extends along the length of the first support member 112. The pivot axis 120 is located substantially in the center of the width of the first member 112. The first support member 112 includes two rows of suction cups 124 extending along the length of the first member 112 and one of the rows is located on one side of the pivot axis 120 while the other row is located on an opposite side of the pivot axis 120. Such positioning of the rows allows the pivot axis 120 to be optimally located for the package rotation that occurs when the support member 112 is pivoted.

In a similar manner, the third support member 116 is mounted by bushings 107 to the lower end of each of the extension arms 110A, 110B at a pivot axis 122 that extends along the length of the second support member 116. The pivot axis 122 is located substantially at the center of the width of the third support member 116. Extension arm 110B is not specifically shown in the drawing Figures but is substantially identical to extension arm 110A and is positioned opposite extension arm 110A. The third support member 116 includes two rows of suction cups 126 extending along the length of the third support member 116, one row being located on one side of the pivot axis 122 and the other row being located on an opposite side of the pivot axis 122. Such positioning of the rows allows the pivot axis 122 to be optimally located for the package rotation that occurs when the support member 116 is pivoted.

Attached to the top of the first support member 112 is a pair of lever arms 142A, 142B that are themselves interconnected by a roller 146 on one end of each of the lever arms 142A, 142B. Similarly, attached to a top side of the third support member 116 are a pair of lever arms 140A, 140B that are themselves interconnected by a roller 144 at one end of each of the lever arms 140A, 140B. The pairs of lever arms 142A, 142B, 140A, 140B provide the linkage for pivoting the first and second support members 112, 116, respectively, in a manner further described below.

The second or center support member 114 is located between the first and third support members 112, 116 and is connected to the second platform 106 through a camming bar 132. An actuator 138 is mounted on the second platform 106 and has an actuating rod 134. The camming bar 132 is connected to the actuating rod 134 by means of a fastener 136. The camming bar 132 engages the rollers 144, 146 of the lever arms when the gripping head is raised. The center support member 114 is guided during vertical movement relative to the outer support members 112, 116 by stationary guideposts 130 that are slidably received in bushings 139 mounted in the second platform 106 of the frame 100.

As shown in FIG. 1, the first, second and third support members 112, 114, 116 are each configured to grip seven packages 118. That is, the suction cups 124, 126, 128 of each of the first, second and third support members 112, 116, 118, respectively, are positioned along the length of each of the first, second and third support members such that a row consisting of seven packages 118 are gripped simultaneously by the suction cups. Of course, each of the support members 112, 114, 116 could be configured to grip various numbers of packages 118 depending on the size of the crate that is to be loaded with the packages 118.

Referring now to FIGS. 3-8, the operation of the gripping head according to the method of the present invention is now described.

Figure 3:
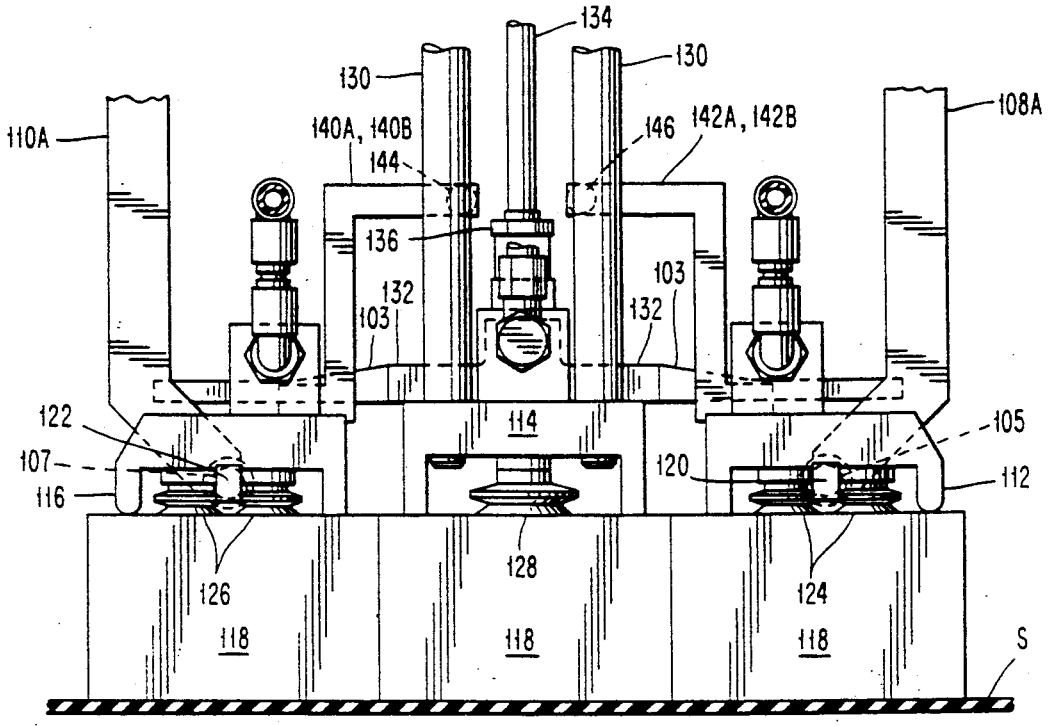
FIG. 3 is a detail side view of a portion of the gripping head as in FIG. 2 showing the initial operating position of the gripping head.

Typically, a conveying system comprising a positioning table S delivers the packages 118, each of which is rectangular box-shaped and is positioned so as to be resting on one of its longitudinal sides, to a gripping head. When delivered to the gripping head, corresponding rows of packages are positioned beneath the first, second and third support members 112, 114, 116 as shown in FIGS. 1 and 3. After the packages 118 have been suitably positioned beneath the gripping head, the actuator 101 lowers the gripping head such that the suction cups 124, 128, 126 of the first, second and third support members 112, 114, 116, respectively, are brought into contact with the uppermost side of each of the individual packages 118. Due to pneumatic suction through each of the suction cups 124, 126, 128, each individual package 118 is secured to the first, second and third support members 112, 114, 116. Since first, second and third support members are configured to support seven packages 118 each, a total of 21 packages 118 are capable of being gripped by the gripping head.

Following gripping of each of the packages 118, then the entire gripping head 100 is raised by the actuator 101 and the positioning table S is removed from the area beneath support members. The removal of the positioning table S reveals a crate ready for receiving packages. Of course, the positioning table S could remain stationary and the gripping head 100 could itself be moved to a location above a crate ready for receiving packages.

Figure 4:
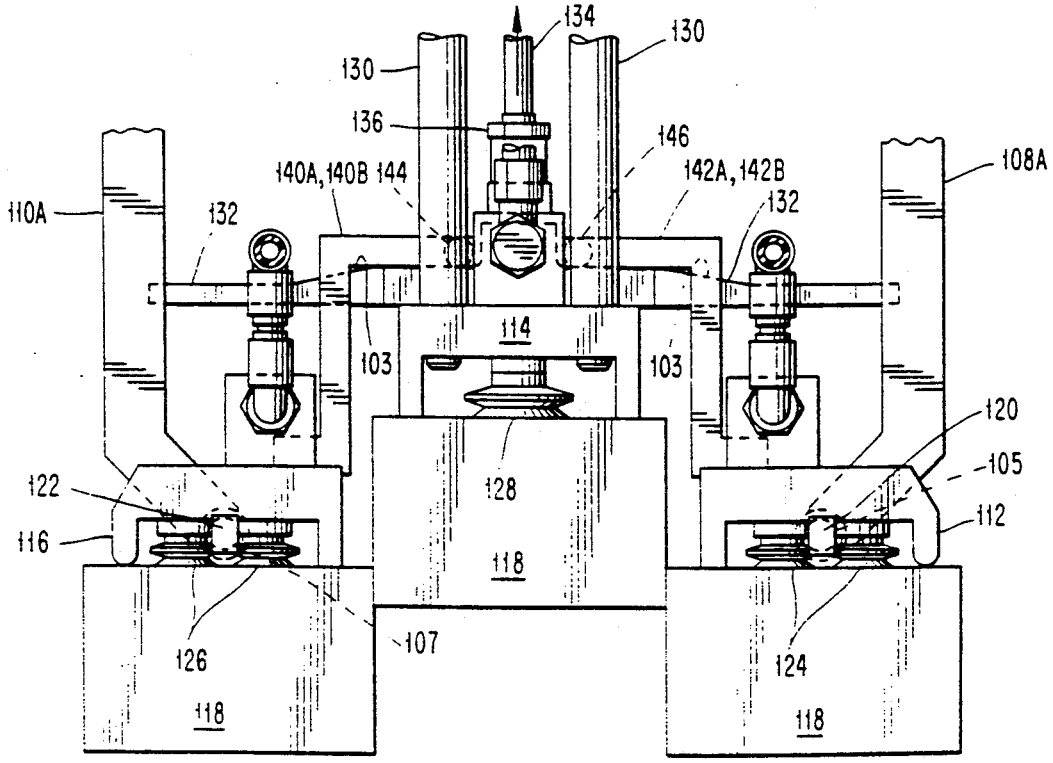
FIG. 4 shows a detail side view of a portion of the gripping head as in FIG. 2 wherein the center support member has been raised relative to the outer support members.

Following raising of the gripping head 100, the actuator 138 is operated to raise the actuating rod 134, thereby raising the center support member 114 upward to the position shown in FIG. 4. With the center support member 114 in this position, the middle row of packages 118 are located above the outer rows of packages secured to the outer support members 112, 116. However, contact of the center row of packages 118 with the outer rows of packages 118 is maintained at the lower edge of each of the center packages 118.

Figure 5:
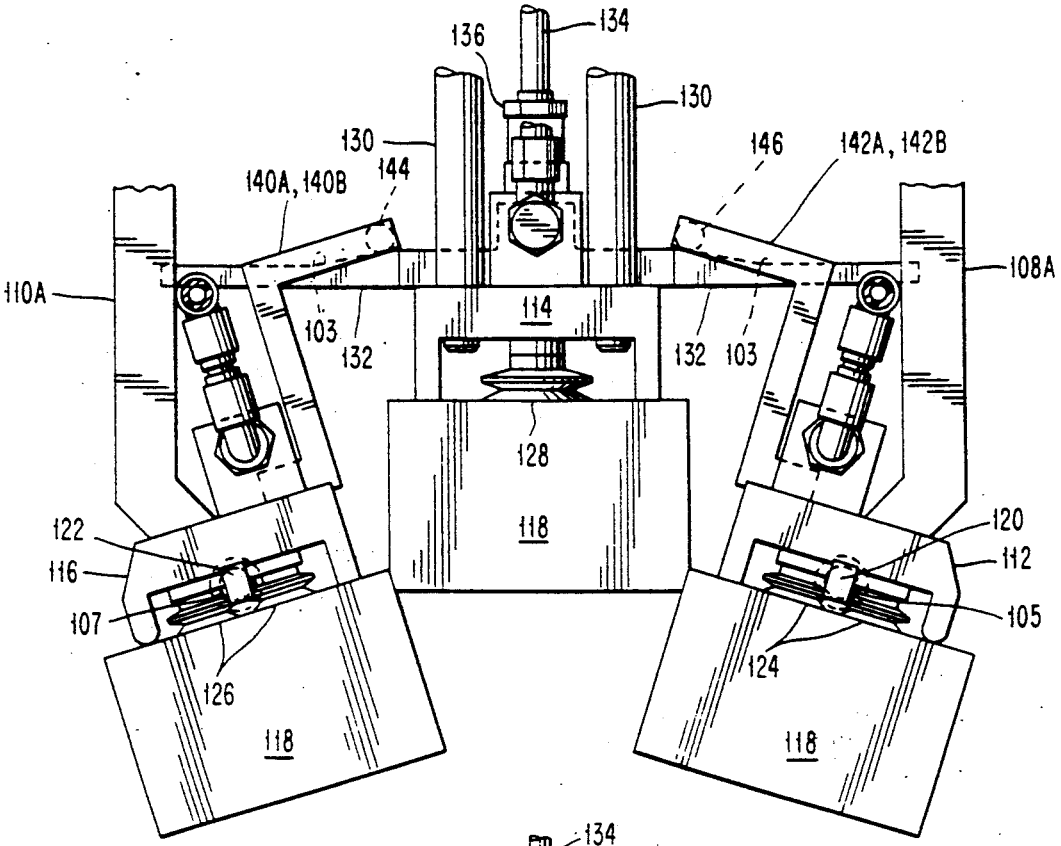
FIG. 5 is a detail side view of a portion of the gripping head as in FIG. 2 wherein the outer support members have been rotated around their respective pivot axes.

As the center support member 114 is raised vertically, the camming bar 132 comes into contact with each of the rollers 144, 146 of the lever arms of each of the first and third support members 112, 116, and as shown in FIG. 5, as the second support member 114, is further raised in the vertical direction, the rollers 144, 146 move outward along the camming surface 103 on either side of the camming bar 132. The linkage provided by the lever arms 140A, 140B, 142A, 142B causes the first and third support members 112, 116 to rotate in a clockwise direction around pivot axis 120 and in a counterclockwise direction around pivot axis 122. It is noted that despite the pivoting movement of the first and third support members 112, 116, the packages 118 of the center support member 114 are maintained in contact with the rows of the adjacent packages 118 of the outer support members 112, 116.

Figure 6:
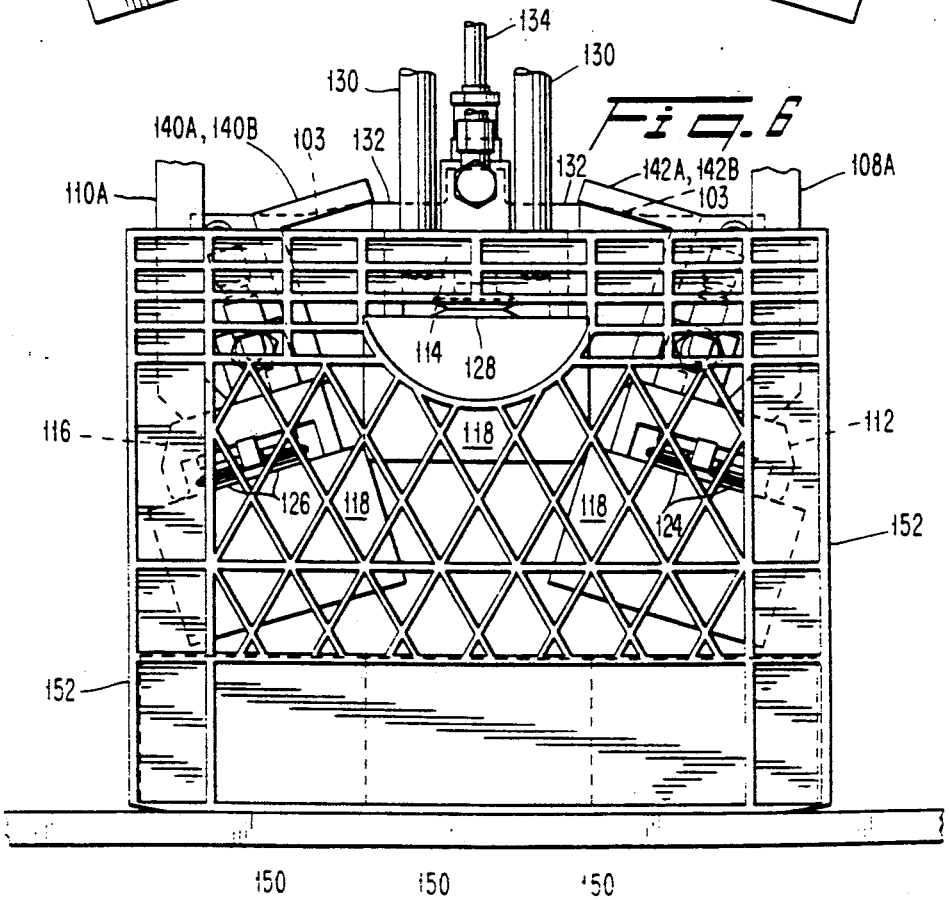
FIG. 6 is a side view of a portion of the gripping head showing the insertion of cartons into a crate.

After the pivoting movement of the first and third support members 112, 116 has been achieved, the upward vertical movement of the actuator rod 134 stops. The gripping head 100 is then lowered relative to a crate 152 such that the packages 118 as gripped by the gripping head are located within the confines of the side walls of the crate 152 as shown in FIG. 6. In FIG. 6, one row of packages 150 has been previously loaded into the crate 152 and is located at the bottom of the crate. Note that since the packages secured to the first and second support members 112, 116, have been pivoted, a clearance exists between the outermost corners of the packages 118 and the inside surfaces of the walls of the crate 152. The clearance thus provides easier placement of the packages within the crate 152.

Figure 7:
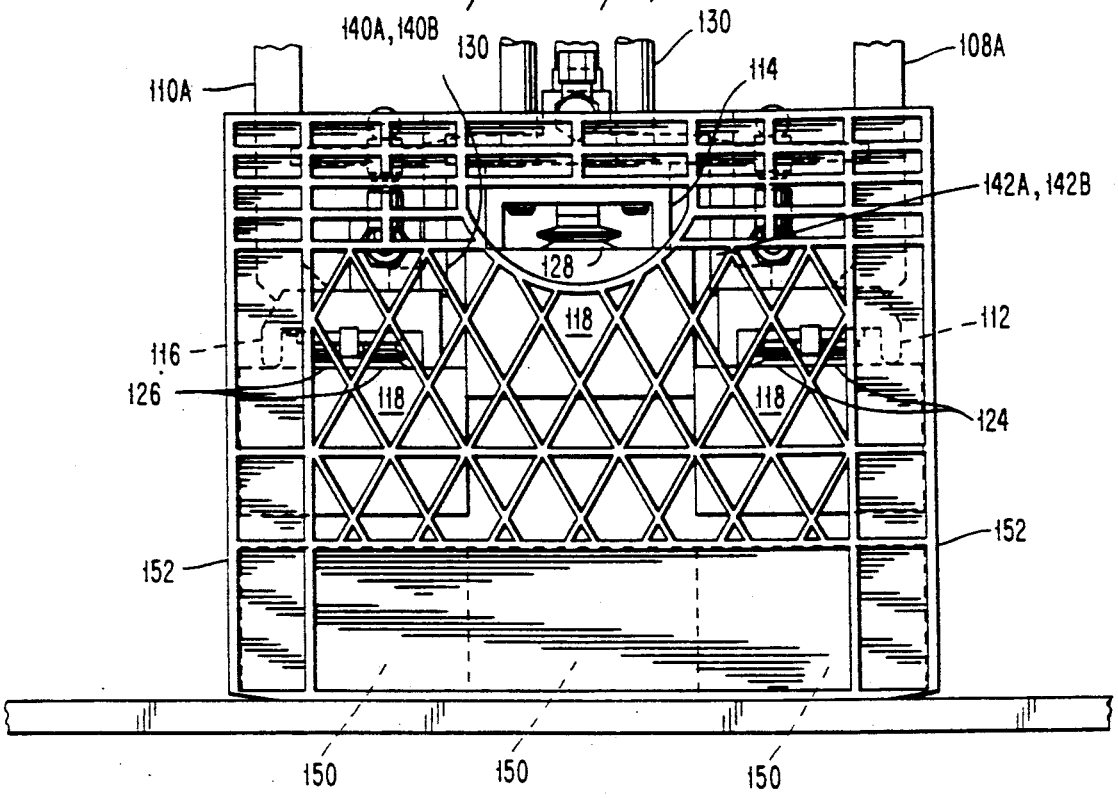
FIG. 7 is a side view of a portion of the gripping head as in FIG. 6 showing the gripping head with the two outer members rotated back to the initial position.

Referring to FIG. 7, after the gripping head has been positioned such that the packages 118 are located substantially within the walls of the crate 152, the actuator 138 is operated to displace the actuating rod 134 downwardly, thereby lowering the center support member 114 relative to the outer support members 112, 116. During lowering movement of the center support member 114, the camming bar 132 disengages from the rollers 144, 146 of the lever arms 140A, 140B, 142A, 142B which, in turn, allows the first and third support members, 112, 116, to pivotally return to the initial position wherein the packages 118 are all in a parallel relationship with one another. Consequently, the outermost sides of the packages 118 of the first and second support members 112, 116 are each positioned in close proximity to the inside surface of the walls of the crate 152.

Figure 8:
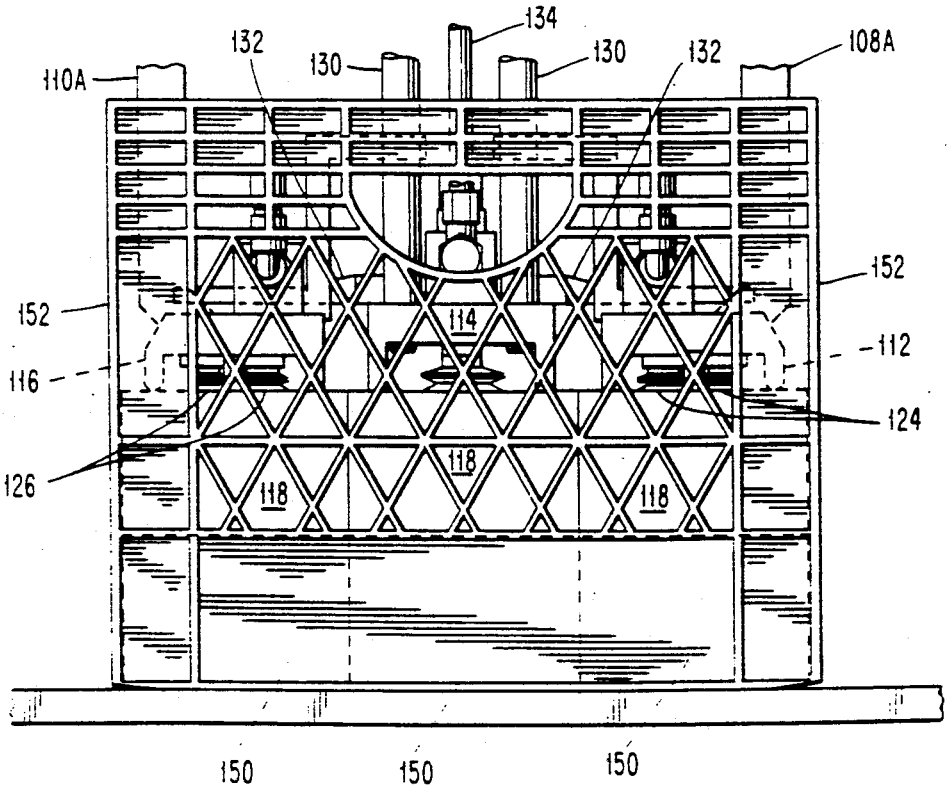
FIG. 8 is a side view of a portion of the gripping head as in FIG. 6 showing the gripping head after placing the packages in final position within the crate before raising the gripping head.

The actuator 138 continues to lower the second support member 114 until the packages 118 secured to the second support member 114 are positioned at substantially the same vertical level as the packages 118 secured to the first and third support members 112, 116 as shown in FIG. 8. During continued movement of the second support member 114, sliding contact between the packages 118 of the second support member 114 and the packages 118 of the first and third support members 112, 116 occurs. However, since the packages 118 are typically fabricated from a flexible material, the sliding contact does not present significant resistance to vertical movement of the second support member 114.

Following the lowering of the second support member 114 to the original starting position, the pneumatic suction through the suction cups 124, 126, 128 is discontinued thus releasing each of the packages 118 from the first, second and third support members 112, 114, 116 and depositing the packages into the crate 152. The gripping head is then raised from within the crate 152 and the sequence of steps just described is repeated until a desired number of packages 118 have been deposited within the crate 152.

In this manner, packages 118 may be quickly and easily loaded into a crate 152. Furthermore, due to the pivoting nature of the first and third support members 112, 116, additional structure to guide the placement of the packages 118 into a crate 152 is avoided. Additionally, compact packing of the packages 118 within a crate 152 is achieved, thus providing efficient use of crate area.

The principles, preferred embodiments and the modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations, changes and equivalents may be made by others without departing from the spirit of the present invention. Accordingly, it is expressly intended that all such variations, changes and equivalents which fall within the spirit and scope of the present invention as defined in the claims, be embraced thereby.

What is claimed is:

1. A gripping head for loading parallelepiped packages into a crate comprising:

frame means;

first, second and third support members each of which having means for gripping a surface of said parallelepiped packages;

pivotal mounting means for mounting each of said first and third members on said frame means for pivoting movement relative to said frame means;

central mounting means for mounting said second member on said frame means between said first and third members, said central mounting means including means for displacing said second member along a predetermined axis relative to said first and third members; and cam means for pivoting said first and third members in response to movement of said second member along said axis relative to said first and third members such that parallelepiped packages gripped on said first and third support members become inclined relative to parallelepiped packages gripped on said second support member.

2. A gripping head for loading packages into a crate according to claim 1, wherein said means for displacing said second member includes an actuator and an actuating rod connected to said second member.

3. A gripping head for loading packages into a crate according to claim 2, wherein said cam means includes a first member linkage arm assembly and a third member linkage arm assembly and a camming bar, said first and third member linkage arms engagable with said camming bar to pivot said first and third members about said pivotal mounting means.

4. A gripping head for loading packages into a crate according to claim 1, wherein said means for gripping of each of said first, second and third members comprises a plurality of suction cups, said suction cups being disposed in a row along a bottom surface of each of said first, second and third members.

5. An apparatus for loading parallelepiped packages into a crate comprising:

frame means;

a pair of outer support members for holding a surface of said parallelepiped packages;

means for mounting said outer members on said frame means including a bushing for pivoting each of said outer members about a fixed axis on said frame means, the fixed axis for the respective outer members being spaced apart from each other and being substantially parallel, a center support member supported by said frame means for displacement along a predetermined axis perpendicular to the axis of said bushings, actuator means for displacing said center member along said predetermined axis, said center member including cam means between said outer members and said center member for pivoting said outer members in unison upon displacement of said center member along said predetermined axis, and means on said center and outer members for gripping said parallelepiped packages such that packages on said outer members become inclined to packages on said center member when said outer members are pivoted.

6. An apparatus for loading packages into a crate according to claim 5, wherein said pair of outer support members each include a linkage arm assembly for engaging said cam means to pivot said outer support members about the fixed axis for the respective support members.

7. An apparatus for loading packages into a crate according to claim 5, wherein said means for gripping packages includes a plurality of suction cups, said suction cups being disposed in a row along a bottom surface of said center and outer members.

8. An apparatus for loading packages into a crate according to claim 6, wherein said cam means includes a camming bar having a camming surface for engaging a roller in each of said outer member linkage arm assemblies, said camming surface engaging said rollers when said center member has been displaced a predetermined distance along said predetermined axis.

9. An apparatus for loading packages into a crate according to claim 5, wherein said apparatus further comprises a means for vertically moving said apparatus such that said center support member and outer support members may be raised and lowered into and out of a region bounded by the inside surfaces of the sides of a crate.

10. A method for positioning parallelepiped packages into a crate comprising the steps of:

positioning first, second and third rows of parallelepiped packages beneath first, second and third support members of a gripping head, said second support member being positioned between said first and third support members;

gripping surfaces of said parallelepiped packages such that said first, second and third rows of parallelepiped packages are held in alignment with said first, second and third support members, respectively;

raising said second row of parallelepiped packages relative to said first and third rows;

pivoting said first and third rows of parallelepiped packages in opposite directions relative to each other so as to incline said first and third rows of parallelepiped packages relative to said second row;

positioning said gripping head such that said first, second and third rows are located within a region bounded by inside surfaces of sides of a packing crate; and, depositing said rows of parallelepiped packages into said crate.

11. A method for positioning packages into a crate according to claim 10, wherein said step of depositing said rows into said crate includes lowering said second row of packages relative to said first and third rows and pivoting said first and third rows with respect to each other such that said first, second and third rows are substantially parallel to one another.

12. A method for positioning packages into a crate according to claim 11, wherein said step of depositing said rows into said crate further includes releasing said packages from said first, second and third support members.

13. A method for positioning packages into a crate according to claim 10, wherein said packages are gripped by pneumatically operated suction cups disposed on a bottom surface of each of said first, second and third support members.

14. A method for positioning packages into a crate according to claim 10, wherein said second row is maintained in constant contact with said first and third rows.

15. A method for positioning packages into a crate according to claim 10, further including the step of returning said gripping head to a position to receive additional rows of packages.

16. A method for positioning packages into a crate according to claim 10, wherein prior to said step of raising said second row of packages relative to said first and third rows, said gripping head is raised and a positioning table is removed such that said gripping head is positioned above a crate ready for receiving packages.

17. A method for positioning packages into a crate according to claim 10, wherein prior to said step of raising said second row of packages relative to said first and third rows, said gripping head is raised and moved to a location above a crate ready for receiving packages.

* * * * *